US005392827A

United States Patent [19]

Yasso et al.

[11] Patent Number: 5,392,827

[45] Date of Patent: Feb. 28, 1995

[54] APPARATUS FOR BULK DISPENSING OF LIQUIDS

[76] Inventors: Adel K. Yasso, 6106 S. Center Rd., Grand Blanc, Mich. 48439; Phil DeBerry, 1975 Reidsview Dr., White Lake, Mich. 48383; Paul Lemley, 27515 Shackett Dr., Warren, Mich. 48093

[21] Appl. No.: 127,635

[22] Filed: Sep. 27, 1993

[51] Int. Cl.[6] ..... B65B 1/30; B65B 3/28

[52] U.S. Cl. ..... 141/192; 141/206; 141/83; 141/88; 141/94; 222/129.1; 222/27

[58] Field of Search ..... 141/192, 198, 206, 207, 141/209, 83, 88, 94, 95, 96–98, 21, 372; 222/108, 129.1, 52, 153, 64, 65, 23, 27

[56] References Cited

U.S. PATENT DOCUMENTS

| | | | |
|---|---|---|---|
| 2,718,630 | 9/1955 | Wait | 141/94 |
| 3,250,303 | 5/1966 | Sollmann | 141/372 |
| 3,599,833 | 8/1971 | Reichenberger | 222/129.1 |
| 3,638,392 | 2/1972 | Welker, Jr. et al. | 222/64 |
| 3,856,059 | 12/1974 | Hartness et al. | 141/165 |
| 4,126,163 | 11/1978 | Hartness et al. | 141/269 |
| 4,164,964 | 8/1979 | Daniels | 141/329 |
| 4,469,150 | 9/1984 | Grimaldi | 141/98 |
| 4,498,508 | 2/1985 | Scholle et al. | 141/5 |
| 4,542,836 | 9/1985 | Sparks et al. | 222/27 |
| 4,645,093 | 2/1987 | Jones | 141/98 |
| 4,712,591 | 12/1987 | McCann et al. | 141/88 |
| 4,830,581 | 5/1989 | Hondriks | 417/252 |
| 4,981,024 | 1/1991 | Beldham | 68/12 R |
| 5,014,211 | 5/1991 | Turner et al. | 364/478 |
| 5,088,621 | 2/1992 | Thompson et al. | 222/1 |
| 5,133,393 | 7/1992 | McGinnis | 141/372 |
| 5,154,319 | 10/1992 | Deininger et al. | 222/105 |
| 5,256,863 | 10/1993 | Ferguson et al. | 235/383 |

*Primary Examiner*—Henry J. Recla
*Assistant Examiner*—Steven O. Douglas
*Attorney, Agent, or Firm*—Bliss McGlynn

[57] ABSTRACT

An apparatus for bulk dispensing of liquids from a reservoir includes a pump connected to the reservoir for pumping liquid from the reservoir, a dispensing structure connected to the pump for dispensing the pumped liquid and a measuring structure for measuring an amount of liquid being dispensed.

7 Claims, 2 Drawing Sheets

APPARATUS FOR BULK DISPENSING OF LIQUIDS

BACKGROUND OF THE INVENTION

1. Field of the Invention

The present invention relates generally to dispensing apparatuses and, more specifically, to an apparatus for bulk dispensing of liquids.

2. Description of the Related Art

The popularity of consumer purchase of bulk quantities of foods and other consumables has increased in the past several years. As a result, there is a need in the art to bulk dispense liquids such as laundry liquids which include liquid detergents, fabric softeners and stain removers in a retail environment.

SUMMARY OF THE INVENTION

It is, therefore, one object of the present invention to provide an apparatus for bulk dispensing of liquids.

It is another object of the present invention to provide an apparatus for bulk dispensing of laundry liquids in a retail environment.

To achieve the foregoing objects, the present invention is an apparatus for bulk dispensing of liquids from a reservoir. The apparatus includes a pump connected to the reservoir for pumping liquid from the reservoir, dispensing means connected to the pump for dispensing the pumped liquid and measuring means for measuring an amount of liquid being dispensed.

One advantage of the present invention is that an apparatus is provided for bulk dispensing of liquids and, in particular, laundry liquids such as detergents, fabric softeners, and stain removers in a retail environment. Another advantage of the present invention is that the apparatus allows the consumer to benefit from the economics of scale derived from the elimination of small quantity packaging, handling, storing and associated costs of these types of liquids, thereby lowering the overhead costs to the retailer. Yet another advantage of the present invention is that the apparatus provides a positive effect on consumers through the use of bulk dispensing and product container reuse and on the environment. Still another advantage of the present invention is that the apparatus is designed to be easily located in supermarkets, warehouses, wholesale/retail outlets, convenience stores and gasoline stations.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
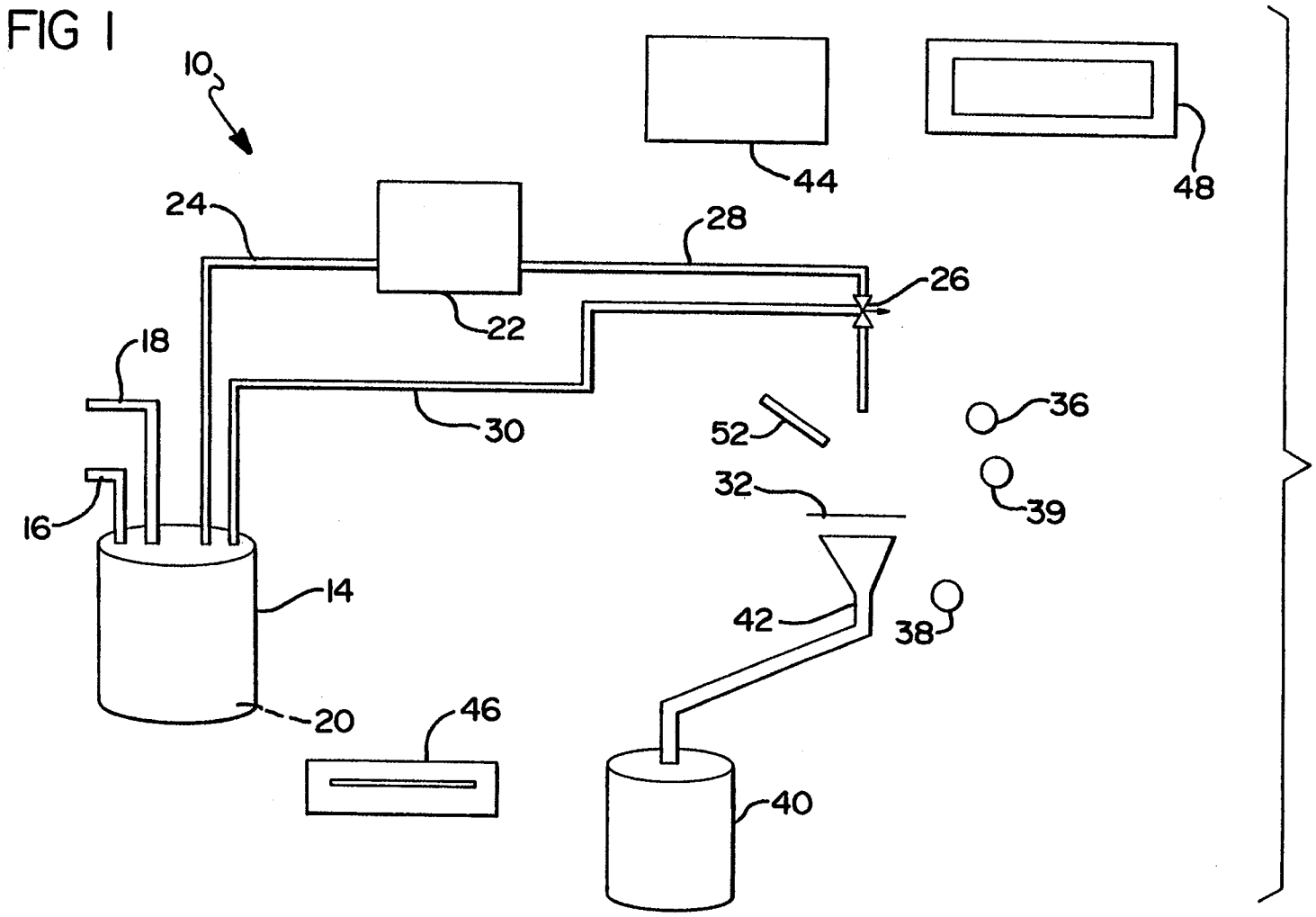
FIG. 1 is a schematic view of an apparatus for bulk dispensing of liquids according to the present invention.
Figure 3:
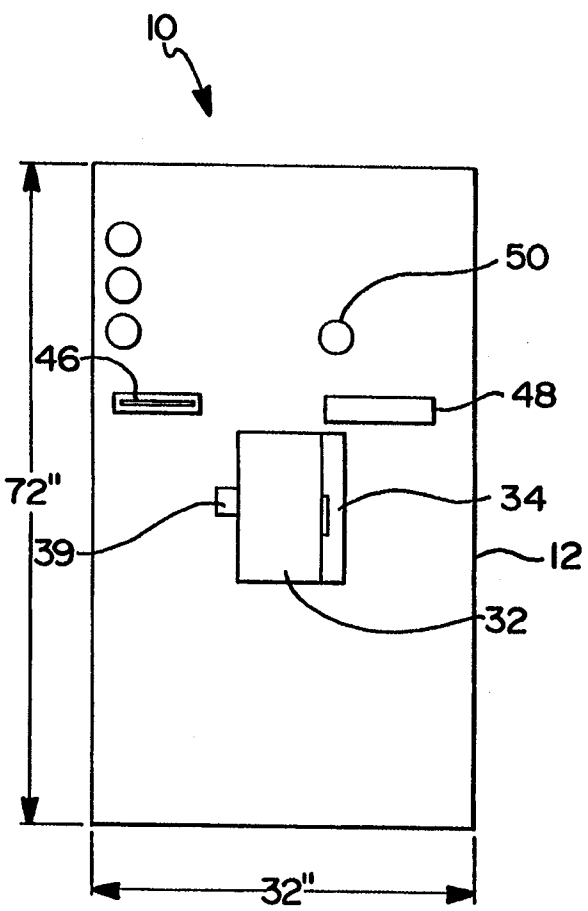
FIG. 3 is a front elevational view of the apparatus of FIG. 1.
Figure 2:
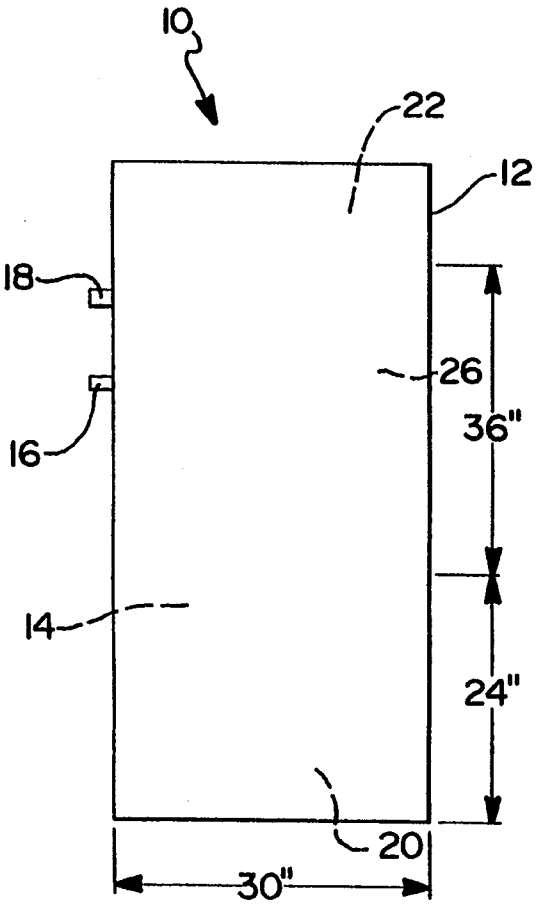
FIG. 2 is a side elevational view of the apparatus of FIG. 1.

Referring to FIGS. 1 through 3, an apparatus 10 is shown for the bulk dispensing of liquids. The apparatus 10 includes a generally rectangular housing 12 and a storage tank or reservoir 14 disposed within the housing 12. The reservoir 14 is generally cylindrical in shape and is used to store a liquid, preferably a laundry liquid, such as liquid detergents, fabric softeners, stain removers, etc. The reservoir 14 has a fill fitting 16 and vent fitting 18 connected thereto and extending through a rear of the housing 12. It should be appreciated that the reservoir 14 may be separate or part of the apparatus 10.

The apparatus 10 also includes a pump 20 connected to the reservoir 14. The pump 20 is of the displacement type, preferably an electric positive displacement pump, to pump the liquid from the reservoir 14. The apparatus 10 includes a flow meter 22 connected by a conduit 24 to the reservoir 14. The flow meter 22 is of the electric positive displacement type to measure or meter the amount of liquid being dispensed. The apparatus also includes an electric solenoid valve 26 connected by a conduit 28 to the flow meter 22. The solenoid valve 26 is of the three way type and is also connected by a conduit 30 to the reservoir 14. The solenoid valve 26 is actuated to dispense the liquid from the apparatus 10.

The apparatus 10 includes a fill chamber 32 for receiving a container, bottle or the like and a slidable door 34 for opening and closing the fill chamber 32. The apparatus 10 also includes a bottle in place switch 36 for sensing whether the bottle is in the proper position for filling and a door closed switch 38 for sensing whether the door 34 is closed. The apparatus 10 further includes a door interlocking device 39 to lock the door 34 while the apparatus 10 is dispensing to prevent removal of the bottle.

The apparatus 10 includes a waste tank 40 connected to an overflow drain 42 disposed beneath the fill chamber 32 for collecting overflow or spilled liquid in the fill chamber 32. It should be appreciated that the waste tank 40 is optional and the overflow drain 42 may be connected to the reservoir 14.

The apparatus 10 also includes a controller 44 having a microprocessor (not shown) connected to and controlling the pump 20, flow meter 22, solenoid valve 26 and door interlocking device 39. The controller 44 is also connected to the switches 36 and 38 for receiving inputs therefrom. The apparatus 10 also includes a printer 46 and a user message display 48 connected to the controller 44 for receiving output from the controller 44. The apparatus 10 also includes a push button 50 for user input to the controller 44. The apparatus 10 further includes a level sensor 52 for sensing the level of fluid in a container in the fill chamber 32.

The apparatus 10 will allow the consumer to insert a container, bottle or the like into the fill chamber 32, close the door 34, and push the green START push button 50 to begin filling the bottle. The bottle is of a predetermined size and the controller 49 is programmed to dispense this amount via the flow meter 22 and solenoid valve 26 as a maximum with each START push button request. If the customer is reusing a container previously provided, and the bottle may contain an amount of previously purchased detergent or other liquid, and an electronic level sensor 52 connected to the controller 44 will insure that the pump 20 is off and the solenoid valve 26 is closed or OFF when a maximum level is sensed by the level sensor 52. This feature eliminates the possibility of the dispensed liquid overflowing the container or bottle.

As the container or bottle is being filled, the consumer may monitor the amount being dispensed into this container both visually and numerically in preselected engineering units displayed on the electronic numerical display 48 located on the front of the housing 12 as the flow meter 22 accurately monitors the dispensed amount. At the same time, the price/unit is also displayed on the display 98. The consumer, at any time, may elect to interrupt the filling of the container by pushing the red STOP push button (not shown) or opening the door 34 of the fill chamber 32. After the filling has been completed, the consumer opens the door 34, interrupting the electrical interlock insuring no additional flow from the reservoir 14. Upon lifting the filled container from the fill chamber 32, an electrical signal is sent to the controller 49, triggering the printing of a bar code sticker detailing total volume dispensed, product identification, and total price by the printer 46. This bar coding, placed on the container, allows the retailer/-wholesaler to set pricing for the item in his/her central computer and eventually charge the consumer the proper amount at the checkout counter.

The logic flow of a methodology for the controller 44 is as follows:

```
TOP:
  IF BOTTLE_IN_PLACE = TRUE THEN
  TURN OFF CYCLE COMPLETE LIGHT
    IF DOOR_CLOSED = TRUE THEN
    IF BOTTLE_NOT_FULL = TRUE THEN
    TURN ON SYSTEM READY LIGHT
      IF CUSTOMER_REQUEST_START - TRUE THEN
      LOCK BOTTLE ACCESS DOOR
      TURN OFF SYSTEM READY LIGHT
      METER_PRESET = 1.0 'GALLONS
        DO WHILE (BOTTLE_NOT FULL = TRUE) OR
(METER_PRESET = FALSE)
          TURN ON SYSTEM FILLING LIGHT
          MAIN_SOAP_PUMP = ON
          DISPENSE_VALUE = OPEN
            IF ERROR_TEST = TRUE THEN
            CALL ERROR_HANDLER
            END IF
        END DO
        TURN OFF SYSTEM FILLING LIGHT
      END IF
    TURN ON CYCLE COMPLETE LIGHT
    PRINT CUSTOMER MESSAGE ON SCREEN
    PRINT PRODUCT IDENTIFICATION ON SLIP
    FOR CUSTOMER
    UNLOCK BOTTLE ACCESS DOOR FOR CUSTOMER
    END IF
  END IF
END IF
DO WHILE BOTTLE_IN_PLACE = FALSE
PRINT CUSTOMER WELCOME MESSAGE WITH
SYSTEM INSTRUCTIONS
END DO
RETURN TO TOP:
```

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An apparatus for bulk dispensing of liquid comprising:

a reservoir for storing liquid;

a pump connected to said reservoir for pumping liquid from said reservoir;

a solenoid-actuated valve connected to said pump for dispensing the pumped liquid;

a flow meter interconnecting said pump and said solenoid-actuated valve for measuring an amount of liquid being dispensed;

a controller connected to said pump and said solenoid-actuated valve and said flow meter for providing a command indicative of the volume and type of liquid dispensed;

a fill chamber for receiving a container and a door for opening and closing said fill chamber;

means for sensing whether said door is in a closed position;

means for locking said door when liquid is being dispensed; and a printer responsive to said command from said controller for providing information including any one of volume dispensed, product identification and total price in a bar code form for later attachment to said container.

2. An apparatus for bulk dispensing of laundry liquid comprising:

a reservoir for storing a laundry liquid;

a pump connected to said reservoir for pumping laundry liquid from said reservoir;

a solenoid-actuated valve connected to said pump for dispensing the pumped laundry liquid;

a flow meter interconnecting said pump and said solenoid-actuated valve for measuring an amount of laundry liquid being dispensed a controller connected to said pump and said solenoid-actuated valve and said flow meter for controlling said pump and said solenoid-actuated valve and said flow meter; and a fill chamber for receiving a container and a door for opening and closing said fill chamber.

3. An apparatus as set forth in claim 2 including means for sensing whether said door is in a closed position.

4. An apparatus as set forth in claim 2 including means for locking said door when laundry liquid is being dispensed.

5. An apparatus as set forth in claim 2 including means for receiving laundry liquid which overflows from said fill chamber.

6. An apparatus for bulk dispensing of laundry liquid comprising:

a reservoir for storing a laundry liquid;

a pump connected to said reservoir for pumping laundry liquid from said reservoir;

a solenoid-actuated valve connected to said pump for dispensing the pumped laundry liquid;

a flow meter interconnecting said pump and said solenoid-actuated valve for measuring an amount of laundry liquid being dispensed;

a controller connected to said pump and said solenoid-actuated valve and said flow meter for controlling said pump and said solenoid-actuated valve and said flow meter;

a fill chamber for receiving a container and a door for opening and closing said fill chamber;

means for sensing whether said door is in a closed position; and means for locking said door when laundry liquid is being dispensed.

7. An apparatus as set forth in claim 6 including means for receiving laundry liquid which overflows from said fill chamber.

* * * * *